US005823500A

United States Patent [19]

La Coste

[11] Patent Number: 5,823,500

[45] Date of Patent: Oct. 20, 1998

[54] CLIPBOARD DRAFTING SYSTEM

[76] Inventor: Lee La Coste, 4013 Kent, Metairie, La. 70006

[21] Appl. No.: 760,034

[22] Filed: Dec. 4, 1996

[51] Int. Cl.[6] ..... A47B 97/04

[52] U.S. Cl. ..... 248/444; 248/444.1; 248/450; 248/452; 248/453

[58] Field of Search ..... 248/452, 441.1, 248/444.1, 450, 453, 444, 451; 281/44, 42; 224/270, 257

[56] References Cited

U.S. PATENT DOCUMENTS

| | | |
|---|---|---|
| 643,164 | 2/1900 | Schnell . |
| 822,691 | 6/1906 | Pashley . |
| 2,862,328 | 12/1958 | Wadsworth . |
| 2,876,022 | 3/1959 | Kroviak . |
| 2,996,830 | 8/1961 | Reichmuth . |
| 3,125,825 | 3/1964 | Gaudette . |
| 4,264,049 | 4/1981 | Daniels . |
| 4,329,799 | 5/1982 | Nagley . |
| 4,474,383 | 10/1984 | Kikis . |
| 4,586,730 | 5/1986 | Shulyak . |
| 4,603,833 | 8/1986 | Barbieri et al. . |
| 4,750,657 | 6/1988 | King . |
| 4,903,932 | 2/1990 | Stewart, Jr. . |
| 5,180,133 | 1/1993 | Chang ..... 248/452 |
| 5,451,025 | 9/1995 | Hames . |
| 5,620,162 | 4/1997 | Beckwith et al. . |

*Primary Examiner*—Milton Nelson, Jr.
*Attorney, Agent, or Firm*—Joseph T. Regard, Ltd

[57] ABSTRACT

A clipboard system for utilization in outdoor environments, wherein there is provided a first, upper section clip for grasping the upper end of a tablet or the like, and a second lower section clip for grasping the lower end of the tablet, a vertically adjustable, linear edge or ruler, a compartment for storing a triangle, pen, or the like, and a strap for supporting the upper end of the clipboard via the neck of the user, the lower end resting upon the hip of the user.

18 Claims, 3 Drawing Sheets

CLIPBOARD DRAFTING SYSTEM

TECHNICAL FIELD OF THE INVENTION

The present invention contemplates a clipboard system for utilization in diverse, on-site locations, wherein there is provided a first, upper section clip for grasping the upper end of a tablet or the like, and a second lower section clip for grasping the lower end of the tablet, a vertically adjustable, linear edge or ruler, a compartment for storing a triangle, straight edge, or the like, and a strap for supporting the upper end of the clipboard via the neck of the user, the lower end resting upon the hip of the user.

BACKGROUND OF THE INVENTION

While the prior art has anticipated numerous various clipboard designs, book holders, or the like, none are believed to suggest or otherwise contemplate the present invention.

Patents which may be of some pertinence to the present invention may include:

| Patent Number | Inventor | Date of Issue |
|---|---|---|
| 1720607 | Reed | 07/09/1929 |
| 2080591 | Wright | 05/18/1937 |
| 2086879 | Redlind | 07/13/1937 |
| 2542290 | Rochford | 02/20/1951 |
| 3106799 | Gawthrop | 10/15/1963 |
| 3289676 | Saunders | 12/06/1966 |
| 4021013 | Wiersma | 05/03/1977 |
| 4264049 | Daniels | 03/28/1981 |
| 4329799 | Nagley | 05/18/1982 |
| 4470571 | Hartman | 09/11/1984 |
| 4474383 | Kikis | 10/02/1984 |
| 4501438 | McKee | 02/26/1985 |
| 4603883 | Barbieri et al | 08/05/1986 |
| 4645163 | Zovar | 02/24/1987 |
| 4702453 | Bishop | 10/27/1987 |
| 4832369 | Johnson et al | 05/23/1989 |
| 4903932 | Stewart, Jr. | 02/27/1990 |
| 5116012 | Offenhauer et al | 05/26/1992 |
| 5145141 | Hunter | 09/08/1992 |

U.S. Pat. No. 4,269,049 illustrates a portable easel having a neck strap, see, for example, FIG. 3 of the patent.

U.S. Pat. No. 4,329,799 illustrates a "Typing Copy Stand" having a top clip, and a vertically adjustable edge, or "paper support strip".

U.S. Pat. No. 4,474,383 teaches a "book holder", wherein there is provided first and second clips for holding a secured in an open position.

U.S. Pat. No. 4,603,883 teaches a clipboard having a pen compartment for securing a pen.

U.S. Pat. No. 4,903,932 teaches a clip board wherein there is provided a lower paper securing means (41) for securing the lower part of a tablet secured to the clipboard for securing the pages of the tablet in place.

U.S. Pat. No. 5,145,141 teaches a clipboard having an upper transparent surface which covers the paper, to provide water resistance in rain and prevent fluttering in wind.

Thus, while there does appear to be various and diverse designs for clipboard, portable drafting tables, book holders, and the like, none appear to contemplate or suggest the present invention.

GENERAL SUMMARY DISCUSSION OF THE INVENTION

Unlike the prior art, the present invention has contemplated a clipboard/drafting system which is easy to implement, lightweight yet rugged, and convenient to use in multiple sites and conditions.

The present invention relates to portable drafting apparatus and clipboards, and particularly to a new and useful, portable clipboard designed for on site drafting of sketches, documents, or other activity in the field.

The preferred embodiment of the present invention teaches a flat, rigid board having a bottom and top surface, the top surface having situated thereon opposing clamping members at each end for securely retaining a tablet, paper or the like thereon. Rigidly suspended from the side edge of the board, in aligned fashion thereto, is a track member configured to support, in slidingly adjustable engagement, the first end of a bar member, the bar member configured for lateral pivotal adjustment to allow for face-to-face engagement with the tablet or any paper or other flat media thereon, for hold-down or drafting use.

Further provided, at generally the top end of the board, is a neck strap for securing the unit about the neck of the user, which strap cooperates with a belt clip situated generally near the lower end of the board, which belt clip engages the belt or pant of the user, the belt clip and neck strap, together with the board, providing a secure, supported writing surface.

An alternative embodiment of the present invention may have formed in the board a template for accepting drafting tools such as a straight edge, ruler, triangle or the like, as well as support legs for supporting the board upon a table or like surface.

The exemplary system was constructed of machined metal, although it is believed that the system will work equally well in a polymer construction.

It is thus an object of the present invention to provide a durable clipboard system which retains both ends of a supporting paper or pad.

It is another object of the present invention to provide a clipboard system which includes a pivotally adjustable, sliding edge member.

It is still another object of the present invention to provide a clipboard system which includes a neck strap for supporting the upper end of the clipboard, and a clip situated at the lower end of the clipboard for engaging the belt, pant, or other garment of the user for support.

It is still another object of the present invention to provide a clipboard system which includes a sliding ruler or hold down bar adjustment means which includes thickness adjustment for allowing full engagement of the ruler or hold down bar to various thickness papers or pads.

Lastly, it is an object of the present invention to provide a clipboard/drafting system which is easy to implement on-site in various diverse conditions, rugged in construction, while requiring little in the way of training or maintenance.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
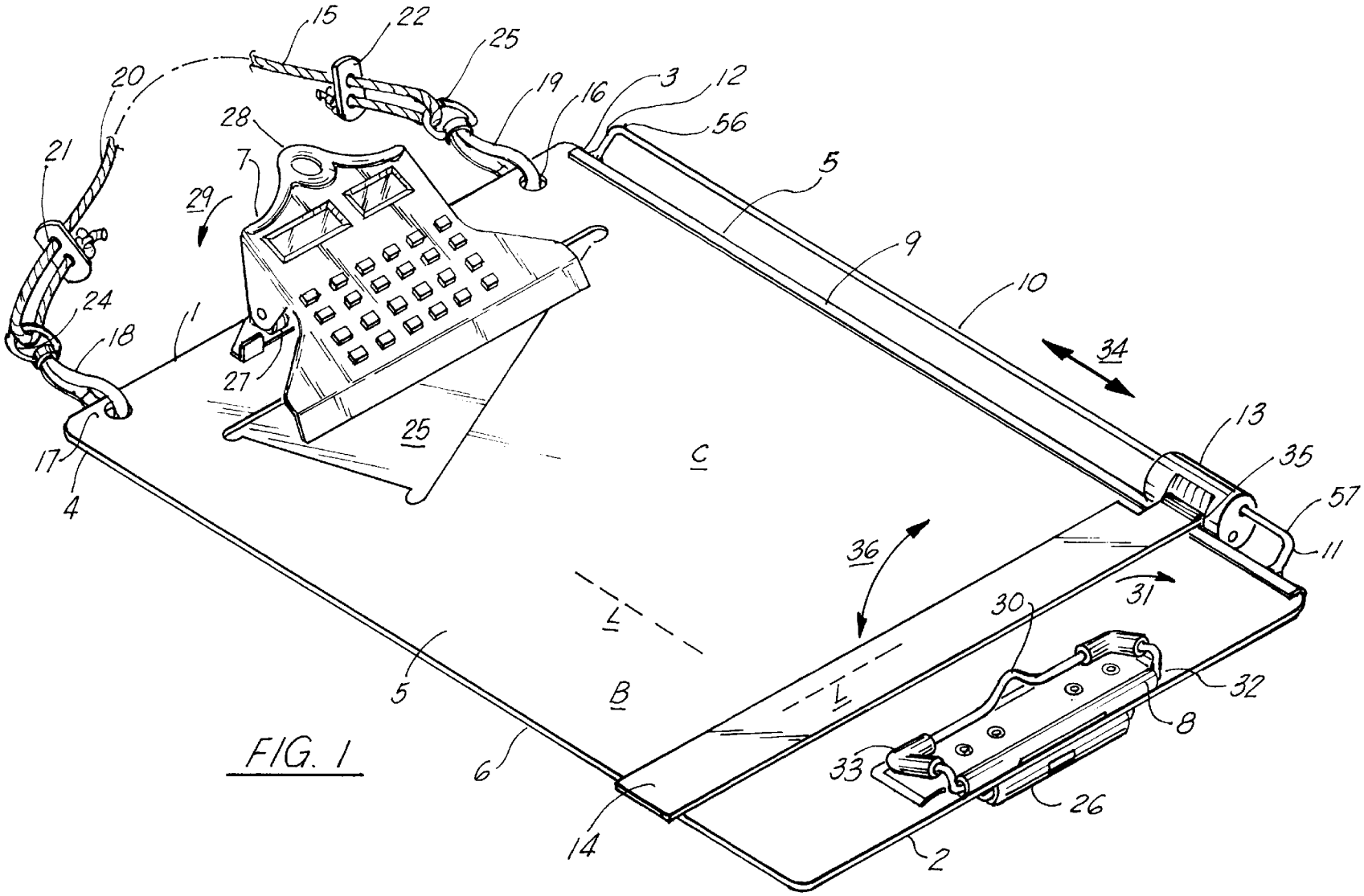
FIG. 1 shows an isometric view of the clipboard system of the present invention, including the sliding ruler or hold down bar, upper and lower clips, neck strap, and belt or garment clip.

The clipboard C of the present invention includes a board B of a generally flat, rigid, rectilinear construction, includes an upper end 1, a lower end 2, first 3 and second 4 edges, and upper 5 side, and a lower 6 side.

Situated upon the upper 5 side of the board B are main and secondary clip members, the main 7 clip situated generally near or at the upper 1 end of the board B, the secondary 8 clip situated generally near or at the lower 2 end of the board.

The main 7 clip is designed as most standard clips found on clipboards; the embodiment shown includes a calculator, as is available in the marketplace. The main clip engages the top of a notepad, sheet of paper or the like, with the user applying pressure 29 to the upper portion 28 (adjacent to the upper end of the board) of the clip towards the board, causing same to pivot, providing space between the lower portion of the clip and the board for placement of the paper, pad, etc desired. Upon release of the pressure, a spring 27 or other bias means urges the lower portion of the clip back against the board, clamping the inserted materials thereto.

The lower 8 clip is also of an off-the-shelf design, but not known to be utilized in the present application. Although other clip designs could also work, the present design is of lighter construction than the main 7 clip, and is configured to hold down the distal end of the paper or pad, etc inserted under the main 7 clip, upon the grasping and lifting 31 of clamp member 30, and the insertion of the bottom end of the inserted contents.

An alternative embodiment of the present invention could utilize, in place of lower 8 clip, an alternative hold down means, including, for example, a hold down cable, elastic band, or adjustable tension line emanating from the board, and wrapped about the paper or pad.

Figure 8:
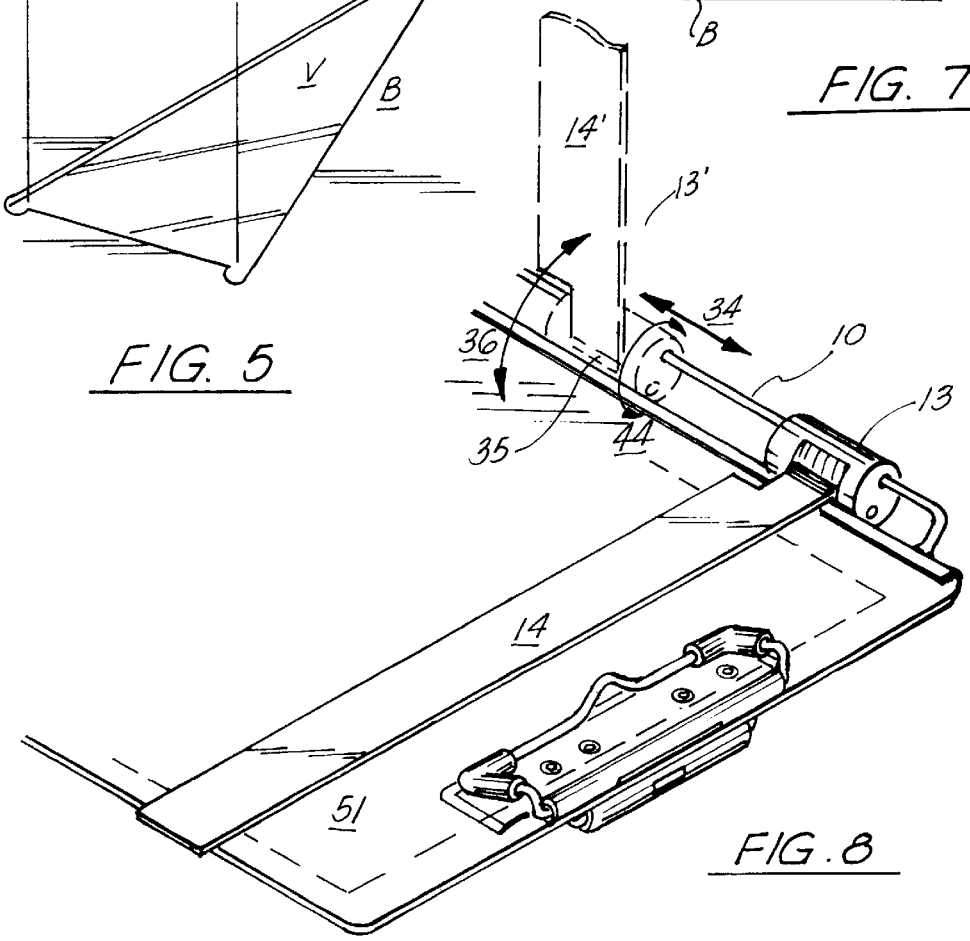
FIG. 8 is an isometric view of the pivotal adjustment mechanism for the sliding ruler or hold down bar of the invention of FIG. 1, showing pivotal movement, further illustrating the pivotal lifting of the ruler or hold down bar from the board for the placement of paper or the like, as well as longitudinal sliding adjustment, for drafting, marking, or holding down of the paper or other media.

Emanating from the first 3 edge of the board is a sliding support base 9, supporting a rail 10 having first 56 and second 57 ends; the rail is spaced from and aligned with the edge and top of the board via lateral support members 11, 12 at opposing ends. Continuing with FIGS. 1 and 8, slidingly engaged to the rail 10 is a pivot piece 13 (further shown in phantom as 13' in FIG. 8), in this embodiment, comprising a cylinder which is configured to be slid 34 along the rail 10 as desired by the user for placement of a ruler 14 or hold down bar at the desired location relative to the contents (51 in FIG. 8) held by the board and clips 7, 8 (shown in FIG. 1). The ruler 14 is linear, and configured to provide an even, flat engagement with the board or contents thereon, and is pivotally affixed 35 to pivot piece 13, so as to allow for the lifting or lowering 36 of the ruler for adjustment, or placing or removing contents, such as pads or paper, onto or from the board. As shown, the ruler is situated along a longitudinal axis L generally transverse to the longitudinal axis L' of the board. Preferably, the ruler 14 should have a width generally corresponding to the length of the pivot piece 13, so that instruments sliding across the full length of the ruler does not engage the pivot piece.

Continuing with FIG. 9, the pivot piece 13 has an outer wall forming a diameter 46 and first 45 and second 45' longitudinally aligned bores therethrough. The first bore 45 situated generally near the outer wall of the pivot piece, and in the case of the shown cylindrical configuration, near the outer wall 46 forming the outer diameter of the pivot piece, the second bore 45' situated in parallel alignment with the first bore, but distal to the first bore, the second bore being situated near the opposite outer wall of the pivot piece, or in the case of a cylindrical configuration as shown, the outer wall area distal to that near the first bore.

As further shown, the rail 10 passes through the first bore, and is configured to allow for the dampened sliding passage therethrough, that is, to slide the pivot piece along the rail would require some amount of pressure from the user, as opposed to a loose engagement. A dampening agent, such as felt 52 or the like, could be packed in the passage between the inner diameter of the passage and the outer diameter of the rail, to facilitate dampened, yet smooth movement as desired. The felt may be packed in by a bore through the outer diameter or wall of the pivot piece, in communication with bore 45; further, the bore may be threaded to allow for the packing in of felt or the like, and the placement of a screw therein to further pack and retain the felt in communication with the rail 10 in the bore 45. In addition, other dampening agents, such as TEFLON or the like may be utilized. The pivotal attachment 35 piece of the ruler 14 passes through the second bore 45, providing pivotal (44 in FIG. 8) attachment to same.

This configuration allows the ruler 14 to be flatly placed upon a thin stack of paper or pad 47, parallel alignment with the board B, the pivot piece 13 rotating 53 about the rail to accommodate the positioning of the ruler, and the dampening agent providing a means to urge the pivot piece to remain in the adjusted position.

Figure 7:
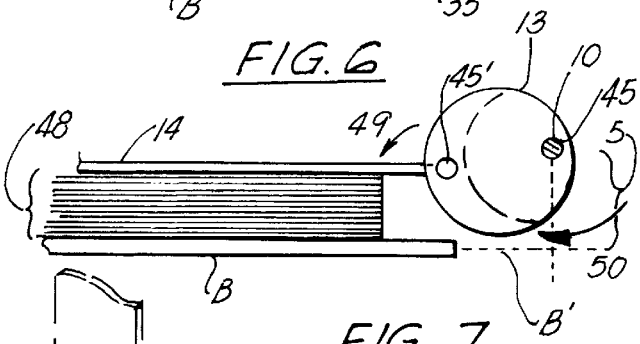
FIG. 7 is an end view of the pivotal adjustment mechanism for the sliding ruler of hold down bar of the invention of FIG. 1, showing the ruler or hold down bar engaging a relatively stack of paper mounted upon the clipboard.

Referring to FIG. 7, with the placement of a thicker pad or stack of paper 48 onto the board, the pivot piece may be further adjusted by rotating same, which pivots 50 the pivot piece relative to the rail 10 and pivots 49 the ruler, via the connections formed in the first 45 and second 45' bores respectively, to again position the ruler 14 as desired flatly upon the pad or stack of paper, in generally parallel alignment with the board, allowing for the utilization of the ruler as a straightedge for drawing, drafting, or sketching, for measurement, or as a hold down bar.

Figure 6:
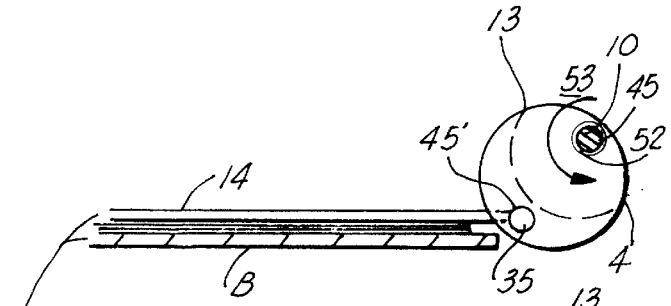
FIG. 6 is an end view of the pivotal adjustment mechanism for the sliding ruler or hold down bar of the invention of FIG. 1, showing the ruler or hold down bar engaging a relatively stack of paper mounted upon the clipboard.

Preferably, the rail 10 should be spaced 54 above the plane B' emanating from the board B an amount sufficient to allow the passage of the pivot piece therebetween a sufficient amount to allow for the placement of the ruler near the board (as shown in FIG. 6). Further, this spacing allows a triangle, straightedge, or other instrument to pass under the rail when said instrument is being utilized upon paper on the clipboard, so as not to encumber placement of said instrument upon said paper. Also, spacing the rail from the this allows for the rail to be utilized as a handle for carrying the clipboard.

Returning to FIG. 1, adjacent to the upper end of the board B, there is formed therein first 16 and second 17 holes for allowing the engagement of first 19 and second 18 clips, respectively, which hold a strap 20 or line configured to form a support strap 15, configured to be placed about the neck, (42 in FIG. 2) shoulder, or arm of the user for supporting the board surface for writing, sketching, or like activities. The strap may be pivoted via first 23 and second 24 pivots at opposing ends, and may be adjustable via first 22 and second 21 adjustment loops, respectively, as is more fully shown in FIG. 2, wherein the adjustment of the straps is illustrated, as well as the placement of the strap 20 about the neck of the user U.

Figure 5:
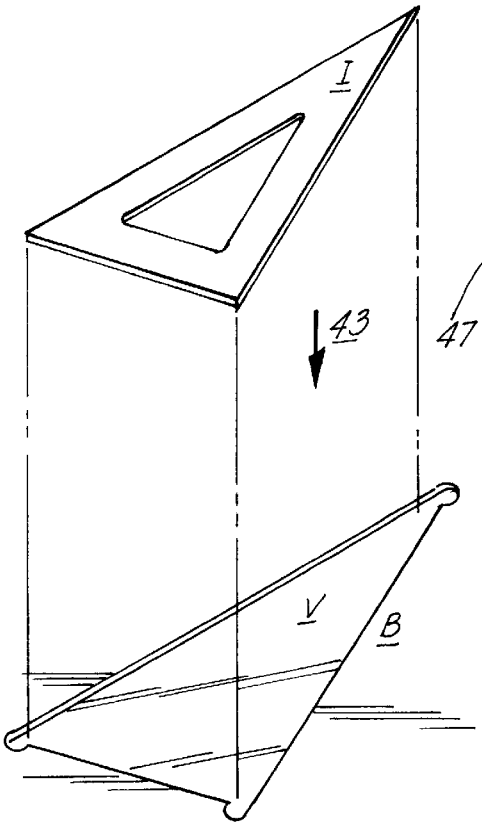
FIG. 5 illustrates an isometric view of a mounting template formed in the board member for receiving an exemplary triangle.

Continuing with FIG. 1, the board may have formed therein, along the upper side 5, a template 25 for receiving a triangle, straightedge, or the like, in the illustrated embodiment, located under the main clip 7, or the secondary clip, so that the user may place the stored instrument in the template and allow the clip to hold down same. Referring to FIG. 5, the void V forming the template in the board B should be of a depth corresponding to the thickness and configuration of the instrument 1, such that when the instrument is placed 43 in the template, there is a flat surface formed above the template which corresponds generally with the flat surface of the board.

Returning to FIG. 1, situated generally at or near the lower end 2 of the board B, and generally emanating from the lower side 6 of the board, is a user clip 26, configured to engage the garment, belt or other portion of a user for holding the supporting the lower edge of the clipboard C thereon.

Figure 2:
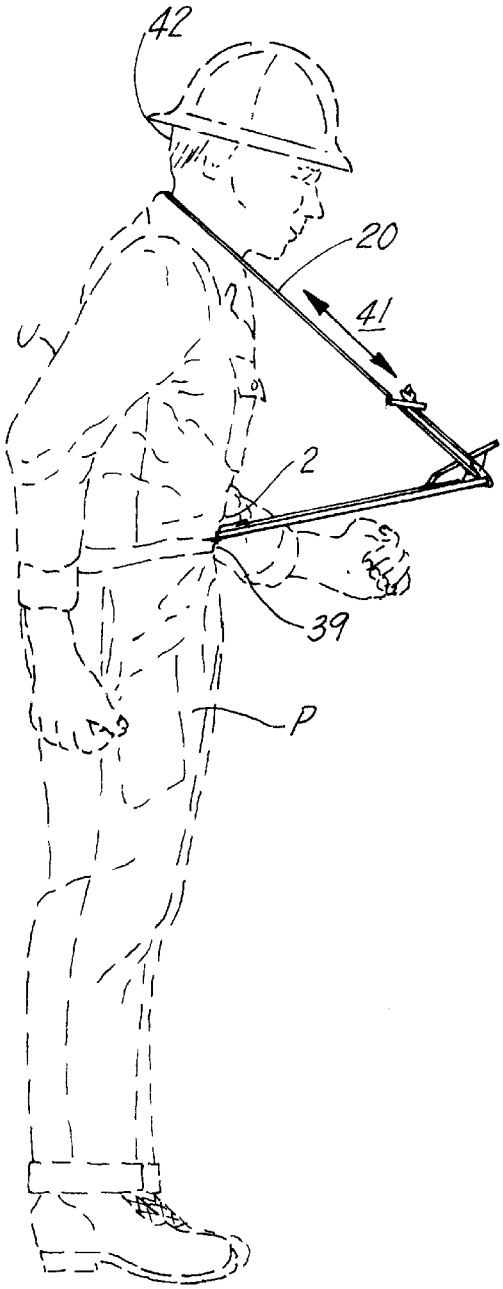
FIG. 2 shows a side view of the invention of FIG. 1, wherein the clipboard system of the present invention is shown mounted upon a user for use.
Figure 3:
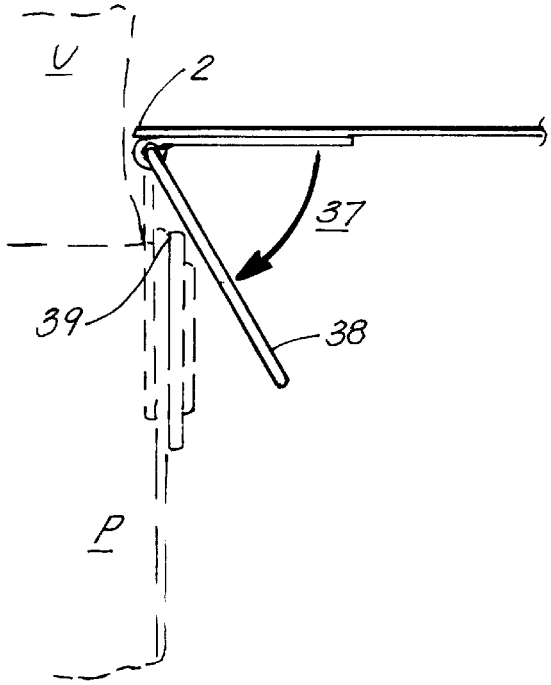
FIG. 3 illustrates the construction and operation of the garment clip of the present invention of FIG. 1, and its exemplary engagement with the belt of the user.
Figure 4:
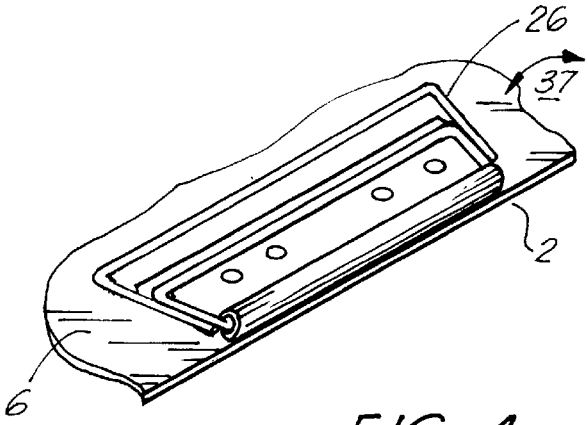
FIG. 4 illustrates an isometric view of the garment clip of FIG. 3.

Referring to FIG. 4, the user clip 26 is pivotally 37 affixed the lower side of the board B, at the lower end 2, Referring to FIG. 3, in use, the user U pivots 37' the support piece 38 so that it is situated generally transverse to the lower side of the board, and inserts the support piece over the belt or pant of the user, and between 40 the belt 39 and/or pant P and the user, generally in front of the user, so as to allow the upper edge of the belt or pant to support the lower end 2 of the board, while allowing the support piece to removably anchor the board in place, as is more fully illustrated in FIG. 2.

The exemplary embodiment of the present invention is constructed of, for example, ⅛" aluminum sheet, with the rail, pivot piece, and ruler being stainless steel. However, it is noted that the present invention may be formed of various diverse materials, including but not limited to plastic or the like.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A clipboard, comprising:

a board having a generally flat, rigid, rectilinear construction, said board having an upper end, a lower end, first and second edges, an upper side, a lower side, and a longitudinal axis;

a main clip member situated upon the upper side of said board, said main clip situated generally near said upper end of said board;

a rail having first and second ends, said rail spaced from and aligned with said first edge and upper side of said board, said rail further having first and second lateral support members emanating from said first and second ends, said first and second lateral support members affixed to said board generally adjacent to said upper and lower ends of said board, respectively;

a generally flat, linear hold down member in transverse, pivotal, sliding communication with said rail, said linear hold down member having a longitudinal axis which is transverse to said longitudinal axis of said board, said linear hold down member configured to engage said board in surface to surface engagement.

2. The clipboard of claim 1, wherein there is further provided hold down means for holding down an article placed upon said board, said hold down means associated with the upper side of said board, at about said lower end of said board.

3. The clipboard of claim 2, wherein said hold down means comprises a secondary clip situated generally at said lower end of said board on said upper side of said board, said main and secondary clip members situated in relatively opposing fashion relative to one another.

4. The clipboard of claim 3, wherein there is further provided a strap affixed to said upper end of said board to engage a user to support said upper end of said board.

5. The clipboard of claim 4, wherein there is further provided a user clip situated adjacent to said lower end of said board, said user clip configured to engage a user to support said lower end of said board.

6. The clipboard of claim 5, wherein said user clip is further situated on said lower side of said board.

7. The clipboard of claim 6, wherein the upper side of said board has formed therein a template for accepting and retaining a drawing instrument having a configuration and thickness, said template having a configuration and depth corresponding generally to the configuration and thickness of said drawing instrument.

8. The clipboard of claim 7, wherein said template is formed under said main clip to allow said main clip to hold said instrument in place.

9. The clipboard of claim 7, wherein said template is formed under said secondary clip to allow said second clip to hold said instrument in place.

10. The clipboard of claim 1, wherein there is further included a pivot piece having an outer wall and first and second ends, said pivot piece having formed first and second, longitudinally aligned bores therethrough, the first bore situated generally near said outer wall of said pivot piece, said second bore situated in parallel alignment with said first bore, but distal to the first bore, said rail passing through said first bore in pivotal, sliding communication with said pivot piece, said linear hold down member in pivotal communication with said second bore.

11. The clipboard of claim 10, wherein said pivotal, sliding communication between said rail and said pivot piece, via the first bore, is dampened.

12. The clipboard of claim 10, wherein said linear hold down member is a ruler.

13. The clipboard of claim 10, wherein there is further provided a user clip situated adjacent to said lower end of said board, said user clip configured to engage a user to support said lower end of said board.

14. The clipboard of claim 13, wherein said user clip is further situated on said lower side of said board.

15. The clipboard of claim 14, wherein the upper side of said board has formed therein a template for accepting and retaining a drawing instrument having a configuration and thickness, said template having a configuration and depth corresponding generally to the configuration and thickness of said drawing instrument.

16. The clipboard of claim 15, wherein said template is formed under said secondary clip to allow said secondary clip to hold said instrument in place.

17. The clipboard of claim 15, wherein said main clip includes a calculator thereon.

18. The clipboard of claim 15, wherein said template is formed under said main clip to allow said main clip to hold said instrument in place.

* * * * *